US008701569B2

(12) United States Patent
Linares

(10) Patent No.: US 8,701,569 B2
(45) Date of Patent: Apr. 22, 2014

(54) PALLET DESIGN WITH STRUCTURAL REINFORCEMENT

(75) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 139 days.

(21) Appl. No.: 13/414,031

(22) Filed: Mar. 7, 2012

(65) Prior Publication Data

US 2012/0160734 A1 Jun. 28, 2012

Related U.S. Application Data

(63) Continuation-in-part of application No. 12/467,601, filed on May 18, 2009, now abandoned, and a continuation-in-part of application No. 12/414,017, filed on Mar. 30, 2009, now Pat. No. 8,196,527, application No. 13/414,031, which is a continuation-in-part of application No. 13/081,953, filed on Apr. 7, 2011, now Pat. No. 8,418,632, which is a continuation-in-part of application No. 12/608,512, filed on Oct. 29, 2009, now Pat. No. 8,146,516, and a continuation-in-part of application No. 12/467,601, filed on May 18, 2009, now abandoned, which is a continuation-in-part of application No. 12/414,017, filed on Mar. 30, 2009, now Pat. No. 8,196,527.

(60) Provisional application No. 61/074,306, filed on Jun. 20, 2008, provisional application No. 61/328,682, filed on Apr. 28, 2010, provisional application No. 61/472,698, filed on Apr. 7, 2011.

(51) Int. Cl.
*B65D 19/00* (2006.01)

(52) U.S. Cl.
USPC ..... 108/51.3

(58) Field of Classification Search
USPC ..... 108/51.3, 51.11, 57.25, 57.26, 57.27, 108/57.28
See application file for complete search history.

(56) References Cited

U.S. PATENT DOCUMENTS

| | | | |
|---|---|---|---|
| 1,557,935 | A | 10/1925 | Henroz |
| 2,383,736 | A | 8/1945 | Rembert et al. |
| 2,477,852 | A | 8/1949 | Bacon |
| 2,544,657 | A | 3/1951 | Cushman |
| 2,709,559 | A | 5/1955 | Geisler |
| 2,913,206 | A | 11/1959 | Paris |
| 2,914,282 | A | 11/1959 | Budd |
| 3,002,249 | A | 10/1961 | Jackson |

(Continued)

FOREIGN PATENT DOCUMENTS

| | | | |
|---|---|---|---|
| DE | 19541243 | A1 | 5/1997 |
| JP | 60-068254 | A | 4/1985 |

(Continued)

*Primary Examiner* — Jose V Chen
(74) *Attorney, Agent, or Firm* — Gifford, Krass, Sprinkle, Anderson & Citkowski, P.C.; Douglas J. McEvoy

(57) ABSTRACT

A reinforced pallet which is constructed of a generally planar surfaced body constructed of a corrugated material and including a plurality of partition defining members and a corrugated surface board material, such as a paperboard or plastic, applied over the body. A plurality of recessed notches are incorporated in the partition defining members for seating any number of skeletal inner reinforcing members, such as which may be arranged in any of crosswise or overlapping and grid defining fashion.

8 Claims, 9 Drawing Sheets

(56) References Cited

U.S. PATENT DOCUMENTS 3,015,470 A 1/1962 Patchen
3,157,910 A 11/1964 Schlipphak
3,161,247 A 12/1964 Mackie
3,223,379 A 12/1965 Erickson
3,226,764 A 1/1966 Hostettler
3,267,882 A 8/1966 Edward et al.
3,276,530 A 10/1966 Borneman
3,310,616 A 3/1967 Beary
3,351,027 A 11/1967 Ellard, Jr. et al.
3,379,271 A 4/1968 Arthur et al.
3,382,550 A 5/1968 Smith et al.
3,412,439 A 11/1968 Baker
3,416,203 A 12/1968 Ozenne et al.
3,440,976 A 4/1969 Burne
3,448,496 A 6/1969 Arnold et al.
3,513,934 A 5/1970 Crowley
3,556,886 A 1/1971 Reusser
3,568,912 A 3/1971 de Simas
3,580,190 A 5/1971 Fowler
3,587,479 A 6/1971 Geschwender
3,590,446 A 7/1971 Sonneville
3,626,860 A * 12/1971 Blatt ..... 108/51.3
3,659,986 A 5/1972 Gelbman
3,664,272 A 5/1972 Sanders
3,675,595 A 7/1972 Sullivan
3,710,733 A 1/1973 Story
3,719,157 A 3/1973 Arcocha et al.
3,720,176 A 3/1973 Munroe
3,724,979 A 4/1973 Maringer et al.
3,733,157 A 5/1973 Hendry
3,756,342 A 9/1973 Burdick
3,760,899 A 9/1973 Crossman et al.
3,801,255 A 4/1974 Meyer et al.
3,814,778 A 6/1974 Hosoda et al.
3,832,955 A 9/1974 Pottinger et al.
3,859,021 A 1/1975 Kleiber
3,873,257 A 3/1975 Vanotti
3,897,186 A 7/1975 Farfor
3,920,369 A 11/1975 Boehringer et al.
3,942,926 A 3/1976 Bulloch, Jr.
3,955,613 A 5/1976 Lund
3,981,956 A 9/1976 Redmer et al.
3,982,057 A 9/1976 Briggs et al.
3,982,874 A 9/1976 Nobbe
3,989,090 A 11/1976 Kawai
4,063,864 A 12/1977 Oberwelland et al.
4,068,993 A 1/1978 Dacey et al.
4,105,383 A 8/1978 Hanson
4,197,065 A 4/1980 Di Rosa
4,220,100 A 9/1980 Palomo et al.
4,272,856 A 6/1981 Wegener et al.
4,279,583 A 7/1981 Martin, Sr.
4,312,152 A 1/1982 Drury et al.
4,369,024 A 1/1983 Blackwood et al.
4,413,964 A 11/1983 Winstead
4,416,385 A 11/1983 Clare et al.
4,417,639 A 11/1983 Wegener
4,456,449 A 6/1984 Schubert et al.
4,507,348 A 3/1985 Nagata et al.
4,509,637 A 4/1985 Browning
4,520,746 A 6/1985 Walters et al.
4,597,338 A 7/1986 Kreeger
4,611,978 A 9/1986 Sangiorgi
4,715,294 A 12/1987 Depew
4,758,148 A 7/1988 Jidell
4,802,836 A 2/1989 Whissell
4,819,449 A 4/1989 Curti et al.
4,829,909 A 5/1989 Mandel
4,832,562 A 5/1989 Johnson
4,832,587 A 5/1989 Rensen
4,836,762 A 6/1989 Davis, Jr.
4,843,976 A 7/1989 Pigott et al.
4,923,661 A 5/1990 Russo
4,931,340 A 6/1990 Baba et al.
5,023,037 A 6/1991 Zullig
5,032,072 A 7/1991 Heuschkel
5,035,594 A 7/1991 Murayama et al.
5,067,189 A 11/1991 Weedling et al.
5,076,176 A 12/1991 Clasen
5,080,840 A 1/1992 Jost et al.
5,082,712 A 1/1992 Starp
5,143,778 A 9/1992 Shuert
5,171,586 A 12/1992 Heath
5,205,221 A 4/1993 Melin et al.
5,290,165 A 3/1994 Pitha
5,304,050 A 4/1994 Vismara
5,320,048 A 6/1994 Feiner
5,365,858 A 11/1994 Kuhns
5,368,466 A 11/1994 Hehl
5,382,152 A 1/1995 Ravera et al.
5,391,387 A 2/1995 Peters
5,395,227 A 3/1995 Huggins, Sr. et al.
5,401,456 A 3/1995 Alesi, Jr. et al.
5,423,428 A 6/1995 Selz
5,445,514 A 8/1995 Heitz
5,451,157 A 9/1995 Gimenez
5,463,965 A 11/1995 Cordrey
5,473,995 A 12/1995 Gottlieb
5,476,048 A 12/1995 Yamashita et al.
5,537,741 A 7/1996 Peterson et al.
5,551,353 A 9/1996 Fiedler
5,579,686 A 12/1996 Pigott et al.
5,605,102 A 2/1997 Simpson
5,612,064 A 3/1997 Kosman
5,687,652 A 11/1997 Ruma
5,709,913 A 1/1998 Andersen et al.
5,755,162 A 5/1998 Knight et al.
5,769,949 A 6/1998 Cienkus et al.
5,846,576 A 12/1998 Braungardt et al.
5,868,080 A 2/1999 Wyler et al.
5,890,437 A 4/1999 Hill
6,093,011 A 7/2000 Kosman
6,095,061 A * 8/2000 Perazzo ..... 108/51.3
6,209,464 B1 4/2001 Elder
6,224,363 B1 5/2001 Mahan et al.
6,294,114 B1 9/2001 Muirhead
6,357,364 B1 3/2002 Maloney et al.
6,357,366 B1 3/2002 Frankenberg
6,524,426 B1 2/2003 St. John et al.
6,530,330 B2 3/2003 Sepe et al.
6,530,769 B1 3/2003 Rondeau et al.
6,569,509 B1 5/2003 Alts
6,582,216 B2 6/2003 Kosman
6,598,541 B2 7/2003 Vilkki
6,622,642 B2 * 9/2003 Ohanesian ..... 108/57.25
6,655,299 B2 12/2003 Preisler et al.
6,705,237 B2 3/2004 Moore, Jr. et al.
6,745,703 B2 6/2004 Torrey et al.
6,840,181 B2 * 1/2005 Smyers ..... 108/56.1
6,863,003 B2 3/2005 Grainger
6,938,559 B2 9/2005 Wullenweber
6,954,982 B2 10/2005 Isle et al.
6,972,144 B2 12/2005 Roth et al.
6,976,437 B2 12/2005 Fisch et al.
6,986,309 B2 * 1/2006 Sugihara et al. ..... 108/57.25
7,013,814 B2 3/2006 Modesitt et al.
7,143,564 B2 12/2006 Renck
7,150,621 B2 12/2006 Molin
7,197,989 B2 4/2007 Apps
7,238,073 B2 7/2007 Hendrickson
7,255,551 B2 8/2007 Taylor et al.
7,309,226 B2 12/2007 Hansen et al.
7,458,800 B2 12/2008 Scherer et al.
7,469,643 B2 12/2008 Isle et al.
7,658,958 B2 2/2010 Hansen
7,726,248 B2 6/2010 Shuert
7,804,400 B2 9/2010 Muirhead
7,819,068 B2 10/2010 Apps et al.
7,841,281 B2 * 11/2010 Valentinsson ..... 108/57.25
8,047,886 B1 11/2011 McLarty et al.
2001/0050035 A1 12/2001 Mahnken
2002/0007770 A1 1/2002 Vilkki
2002/0106483 A1 8/2002 Obeshaw
2002/0134311 A1 9/2002 Yoshino et al.

(56) References Cited

U.S. PATENT DOCUMENTS

| | | | | |
|---|---|---|---|---|
| 2002/0148393 | A1 | 10/2002 | Milles | |
| 2003/0024443 | A1 | 2/2003 | Hoshi | |
| 2003/0041956 | A1 | 3/2003 | Pigott et al. | |
| 2003/0061974 | A1* | 4/2003 | Smyers | 108/56.1 |
| 2003/0070594 | A1 | 4/2003 | Isle et al. | |
| 2003/0118681 | A1 | 6/2003 | Dahl et al. | |
| 2003/0136315 | A1 | 7/2003 | Kim | |
| 2003/0189152 | A1 | 10/2003 | Elder et al. | |
| 2004/0007164 | A1 | 1/2004 | Herring et al. | |
| 2004/0187745 | A1 | 9/2004 | Rojas et al. | |
| 2005/0076816 | A1 | 4/2005 | Nakano | |
| 2005/0211139 | A1 | 9/2005 | Perrotta et al. | |
| 2005/0241548 | A1 | 11/2005 | Muirhead | |
| 2006/0003044 | A1 | 1/2006 | DiNello et al. | |
| 2006/0075939 | A1 | 4/2006 | Shuert | |
| 2006/0130712 | A1 | 6/2006 | Wang | |
| 2006/0134254 | A1 | 6/2006 | Hansen et al. | |
| 2006/0144301 | A1 | 7/2006 | Borggaard | |
| 2006/0191465 | A1 | 8/2006 | Marcellus | |
| 2006/0201402 | A1 | 9/2006 | Moore et al. | |
| 2006/0235780 | A1 | 10/2006 | Carney | |
| 2006/0288915 | A1 | 12/2006 | Kulbeth et al. | |
| 2007/0215014 | A1 | 9/2007 | Lee | |
| 2007/0283857 | A1 | 12/2007 | Dong | |
| 2008/0053596 | A1 | 3/2008 | Davies et al. | |
| 2008/0060561 | A1 | 3/2008 | Carrasco | |
| 2008/0098935 | A1 | 5/2008 | Roth et al. | |
| 2008/0103944 | A1 | 5/2008 | Hagemann et al. | |
| 2008/0110377 | A1 | 5/2008 | Stevens | |
| 2008/0156234 | A1 | 7/2008 | van de Camp | |
| 2008/0196633 | A1 | 8/2008 | Ho | |
| 2008/0210140 | A1 | 9/2008 | Valentinsson | |
| 2009/0000527 | A1* | 1/2009 | Ficker | 108/57.25 |
| 2009/0007824 | A1* | 1/2009 | Dubois et al. | 108/57.25 |
| 2009/0095172 | A1 | 4/2009 | Madgar | |
| 2009/0188096 | A1 | 7/2009 | Townsend et al. | |
| 2010/0043678 | A1 | 2/2010 | Linares | |
| 2010/0154685 | A1 | 6/2010 | Arinstein | |
| 2011/0240800 | A1 | 10/2011 | Fox, Jr. | |
| 2012/0291678 | A1* | 11/2012 | Howland et al. | 108/53.3 |

FOREIGN PATENT DOCUMENTS

| | | | |
|---|---|---|---|
| JP | 60-148453 | A | 8/1985 |
| JP | 02139341 | A | 5/1990 |
| JP | 03029744 | A | 2/1991 |
| JP | 06156493 | A | 6/1994 |
| JP | 06-235780 | A | 8/1994 |
| JP | 08034014 | A | 2/1996 |
| JP | 08034438 | A | 2/1996 |
| JP | 08336866 | A | 12/1996 |
| JP | 11079180 | A | 3/1999 |
| JP | 11221828 | | 8/1999 |
| JP | 2000085021 | A | 3/2000 |
| JP | 2001-328632 | A | 11/2001 |
| JP | 2002166940 | A | 6/2002 |
| JP | 2003011969 | A | 1/2003 |
| JP | 2003-034330 | A | 2/2003 |
| JP | 2003-267370 | A | 9/2003 |
| JP | 2004090988 | A | 3/2004 |
| JP | 2005104562 | A | 4/2005 |
| JP | 2006036315 | A | 2/2006 |
| JP | 2006036331 | A | 2/2006 |
| JP | 2006298403 | A | 11/2006 |
| JP | 2008023741 | A | 2/2008 |
| JP | 2008087839 | A | 4/2008 |
| KR | 20030034370 | A | 5/2003 |
| KR | 10-0577441 | | 5/2006 |
| KR | 1020090117107 | | 11/2009 |
| WO | 2006082595 | A1 | 8/2006 |

* cited by examiner

PALLET DESIGN WITH STRUCTURAL REINFORCEMENT

CROSS REFERENCE TO RELATED APPLICATIONS

This Application claims the benefit of U.S. Provisional Application 61/472,698 filed on Apr. 7, 2011. This Application is also a Continuation-in-part of application Ser. No. 12/467,601 filed on May 18, 2009, which claims the benefit of U.S. Provisional Application 61/074,306 filed on Jun. 20, 2008 and is a Continuation-in-part of application Ser. No. 12/414,017 filed on Mar. 30, 2009. This Application is also a Continuation-in-part of application Ser. No. 13/081,953 filed on Apr. 7, 2011, which claims the benefit of U.S. Provisional Application 61/328,682 filed on Apr. 28, 2010 and is a Continuation-in-part of application Ser. No. 12/608,512 filed on Oct. 29, 2009, which is a Continuation-in-part of both application Ser. No. 12/467,601 filed on May 18, 2009 and application Ser. No. 12/414,017 filed on Mar. 30, 2009.

FIELD OF THE INVENTION

The present application discloses a pallet exhibiting any type of corrugated paperboard or plastic material and which is incorporated into a structurally reinforced body which may further include an inner skeletal support including such materials as bamboo sections, 2×4 wood beams and aluminum or steel rods or bars.

DESCRIPTION OF THE RELEVANT ART

The prior art is well documented with various type of pallet designs. In additional to conventional wood pallets, additional materials including plastics and the like have been utilized in the construction of load bearing pallets, with varying degrees of effectiveness.

SUMMARY OF THE PRESENT INVENTION

The present invention discloses a reinforced pallet which is constructed of a generally planar surfaced body constructed of a corrugated material and including a plurality of partition defining members and a corrugated surface board material, such as a paperboard or plastic, applied over the body. A plurality of recessed notches are incorporated in the partition defining members for seating any number of skeletal inner reinforcing members, such as which may be arranged in any of crosswise or overlapping and grid defining fashion.

The skeletal members may include any plurality of bamboo, steel or aluminum rod, wooden 2×4 or other elongated and structurally defining members. Inner perimeter defined handholds are formed through the surface board and body. A plurality of foam defining sections may also be arranged around a perimeter of the body.

Other features include a frame portion secured upon a perimeter extending undersides of the pallet body, this such as for assisting in transporting the pallet upon a conveyor. Additional features include body further having a shallower partition defining body combined with interspersed and deepened partition defining sections along both perimeter and interior locations and which collectively define underside receiving forklift apertures.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the following illustrations, the present application discloses a pallet exhibiting any type of corrugated paperboard or plastic material and which is incorporated into a structurally reinforced body. As will be further exhibited, an inner skeletal support can be incorporated into the pallet construction and which may include without limitation such materials as bamboo sections, 2×4 wood beams and aluminum or steel rods or bars, the construction resulting in a desired combination of light weight and enhanced load bearing and dynamic structural resilience.

Figure 1:
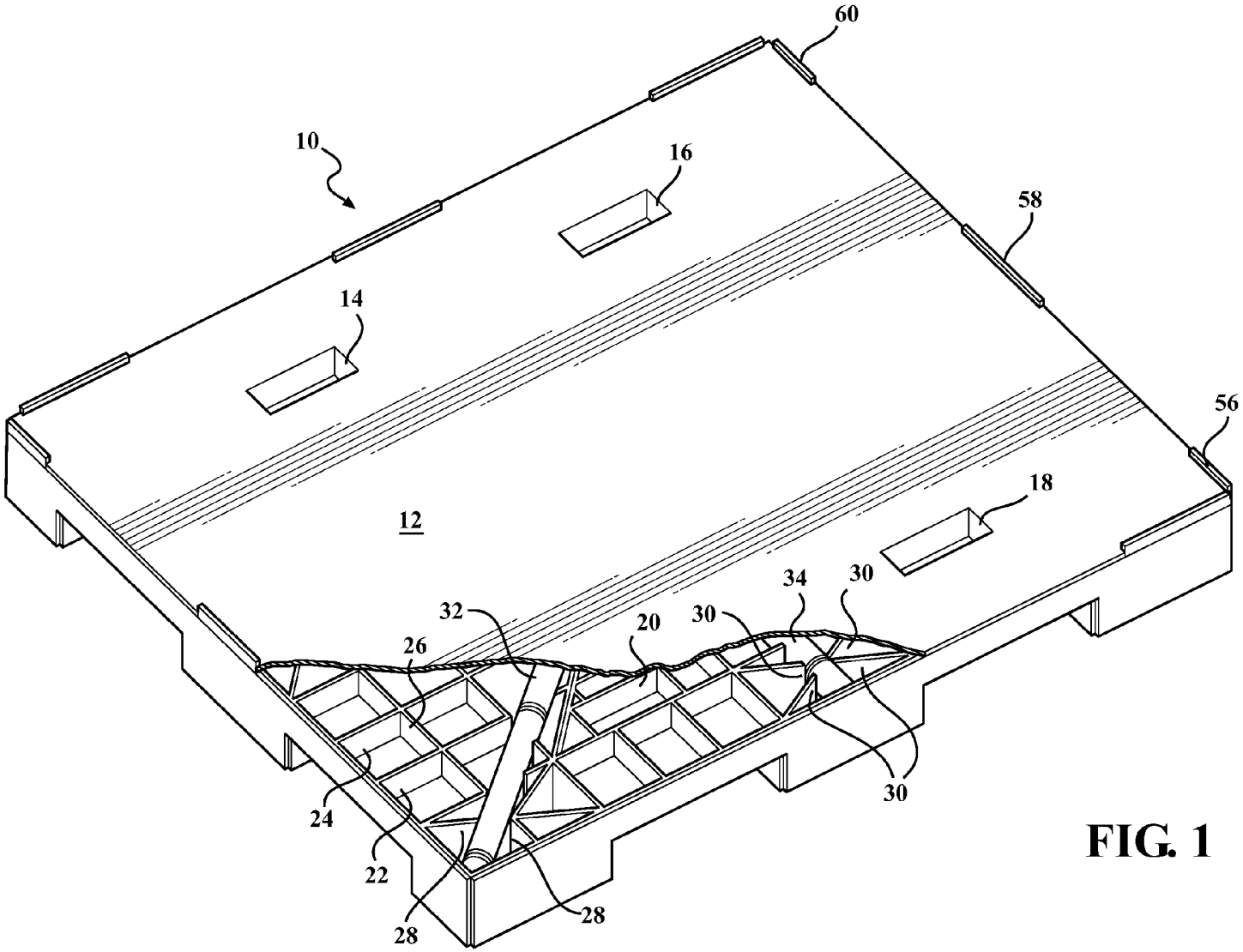
FIG. 1 is a partially cutaway perspective view of a structurally reinforced pallet according to a first configuration and which combines a corrugated paperboard surface material with a structural body exhibiting multiple partitions and which is further configured for supporting an inner skeletal structure in the form of cross wise extending bamboo rods.

Referring now to FIG. 1, a perspective view is shown at 10 in partial cutaway of a selected composite stackable pallet construction according to a first preferred embodiment of the present inventions. As previously described, the stackable pallet construction is designed so as to provide heavy duty support of items located thereupon and exhibits, according to the selected variant, a structural supporting body constructed from any of a heavy duty paperboard or plastic corrugated material which operates to greatly enhance the strength of the pallet assembly in supporting heavier loads set thereupon.

As will be further described, the pallet body can exhibit any type of segmented or partitioned interior providing a desired structural configuration and into which the desired inner skeletal support is integrated. Such designs can also encompass interiorly extending open apertured locations, recesses or other configurations, these further reducing the overall weight of the pallet without compromising its strength. The underside of each pallet can further exhibit linear width and/or length extending recesses, and which are designed to seat inserting forks associated with a conventional forklift machine.

Referring again to FIG. 1, the partially cutaway perspective view of the structurally reinforced pallet 10 combines a corrugated surface material 12 (again shown as a durable paperboard but also envisioning the use of a like corrugated shaped or otherwise configured plastic or other suitable surfacing material). As shown, the surface 12 exhibits a generally rectangular shape and defines a top load supporting surface, with the surfacing material also envisioned to extend across the contiguous side and bottom surfaces of the three dimensional defined body structure as further shown.

A plurality (e.g. four shown) of interior cutout portions, depicted by closed rectangular and inner perimeter extending shapes 14, 16, 18 and 20, are defined within the durable surface board material (and as described through the underlying structural defined pallet body). The cutout portions 14, 16, 18 and 20 accordingly define handhold locations, such as for permitting individual movement of the pallets prior to loading.

With reference again to FIG. 1, as well as succeeding views FIGS. 2-9, a three dimensional and structural body is provided having a general outline matching that of the surface board material 12. Specifically, the body is again constructed of a heavy duty corrugated material, such as a durable paperboard, plasticized or potentially composite type material and, as further shown, exhibits multiple partitions which are representatively depicted in FIG. 1 by selected illustrated intersecting walls 22, 24, 26, et seq., the partitions being formed in intersecting fashion to define a lattice type relationship across the entire area and volume of the body.

The corrugated material forming the surface board 12 layer and/or the structural defining body can include any form of honeycomb pattern or design, such as which may be produced in an initial manufacturing operation which combines three layers of material (including top and bottom layers which sandwich therebetween any formed of undulating or angled middle layer which collectively gives the corrugated material its initial properties of strength and durability). As will be further described, any desired arrangement of ribs or other interior supports can also be provided in order to increase the durability and load bearing characteristics of the structural defining body.

Without elaboration, any suitable fabrication process can be employed in the creation of the structural defined body, such including the provision of a recessed defined template which corresponds to the overall dimensions of the article and which facilitates fast and correct assembly of the individual partitioning and reinforcing structural elements which compose the three dimensional defined body. This can include the use of adhesives or other mechanical bonding agents or techniques for assembling the collectively defining grid and diagonal extending portions which constitute the structural pallet body.

The inner partitions are further collectively designed such as to exhibit inner recesses or channels in any of length, width or diagonal extending fashion (see inner configurations at 28 and 30 in FIG. 1). Suitably configured partitions are defined in spaced apart fashion at each or both of diagonal and/or crosswise arranged locations within the three dimensional interior of the body and such as to facilitate installation of inner skeletal members in the form of both diagonal 32 and crosswise 34 extending bamboo rods, these evident in partially evident fashion and which seat within elongate established recess profiles illustrated.

Figure 3:
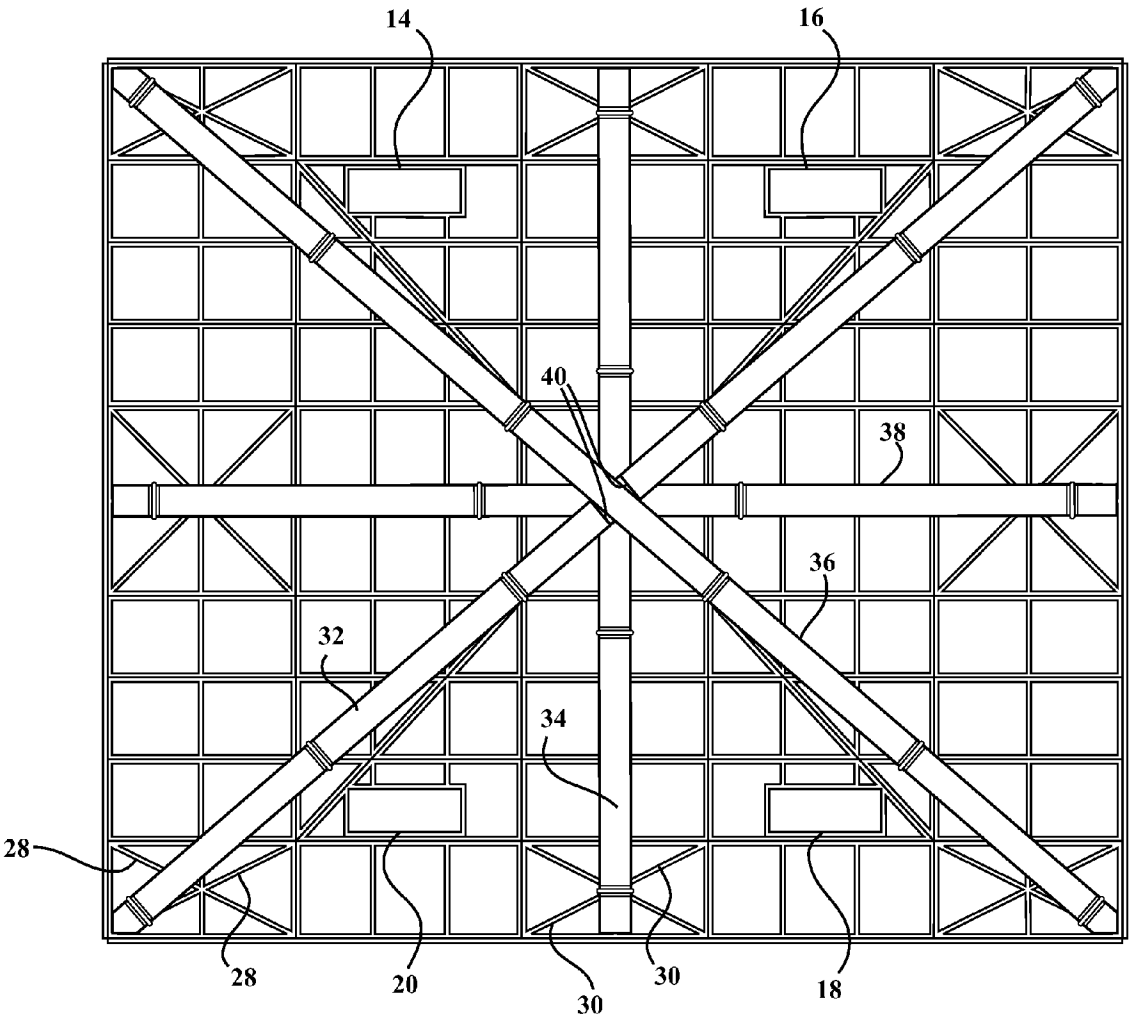
FIG. 3 is a plan view similar to FIG. 1 in which the corrugated surfacing material is removed to reveal the multiple overlapping configuration established by four elongated bamboo sections.
Figure 4:
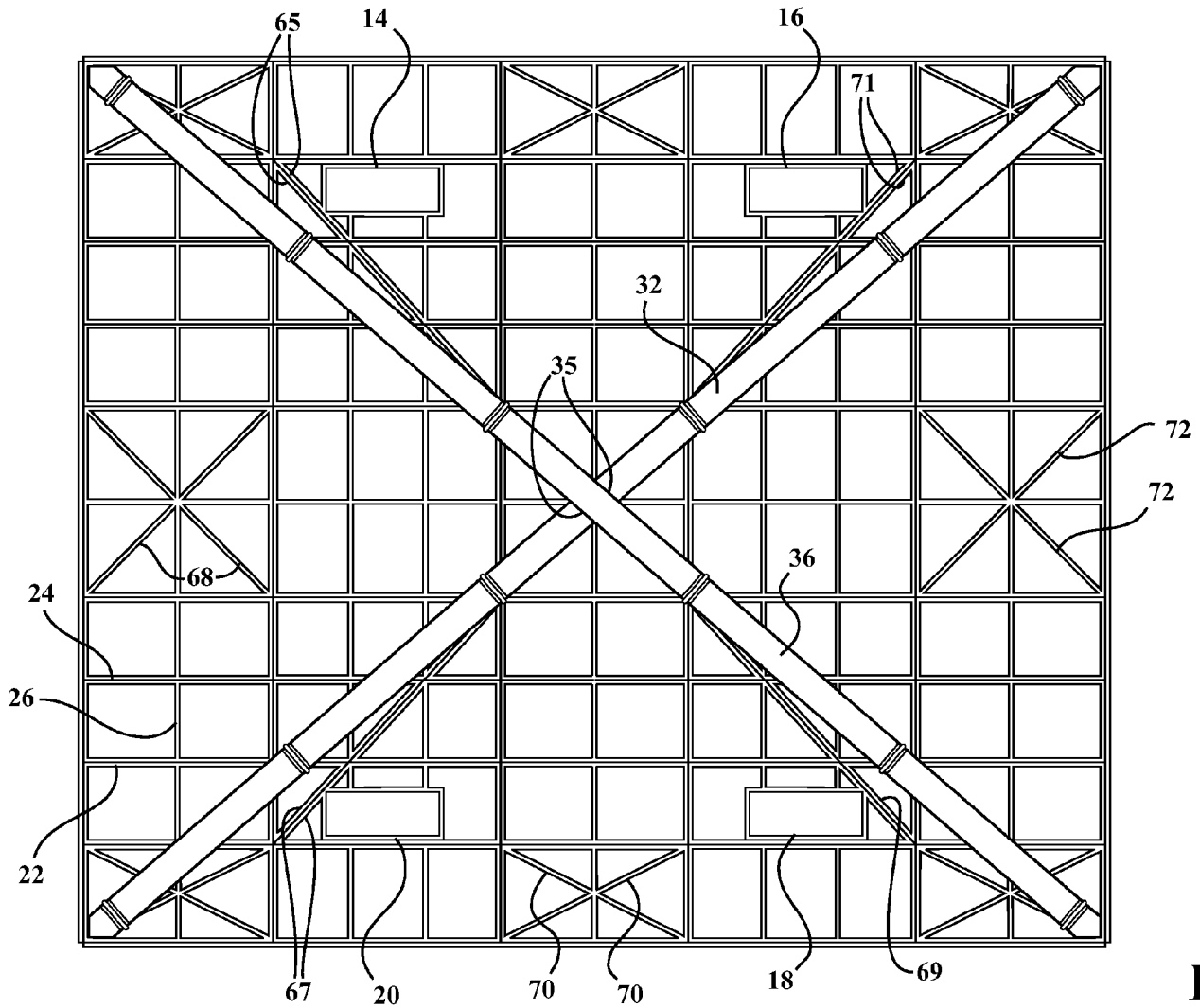
FIG. 4 is an alternate view similar to FIG. 3 and illustrating a single pair of cross extending bamboo sections.

FIG. 3 is a plan view similar to FIG. 1 in which the corrugated surfacing material is removed to reveal the multiple overlapping configuration established by four elongated bamboo rod sections and again including those depicted at 32 and 34, combined with a further pair of overlapping sections 36 and 38. Additional to the inner recessed configurations associated with the partition structure (again inner cutout surfaces 28 and 30 established within aligning and length defining locations within the structurally grid configured interior) the bamboo rods can also be notched or keyed at intermediate overlapping locations, (see at 40) in order to facilitate being arranged in a crosswise fashion. FIG. 4 is an alternate view similar to FIG. 3 and illustrating a single pair of cross extending bamboo sections 32 and 36, a corresponding intermediate notching of selected bamboo section 32 likewise being depicted at 37.

Figure 2:
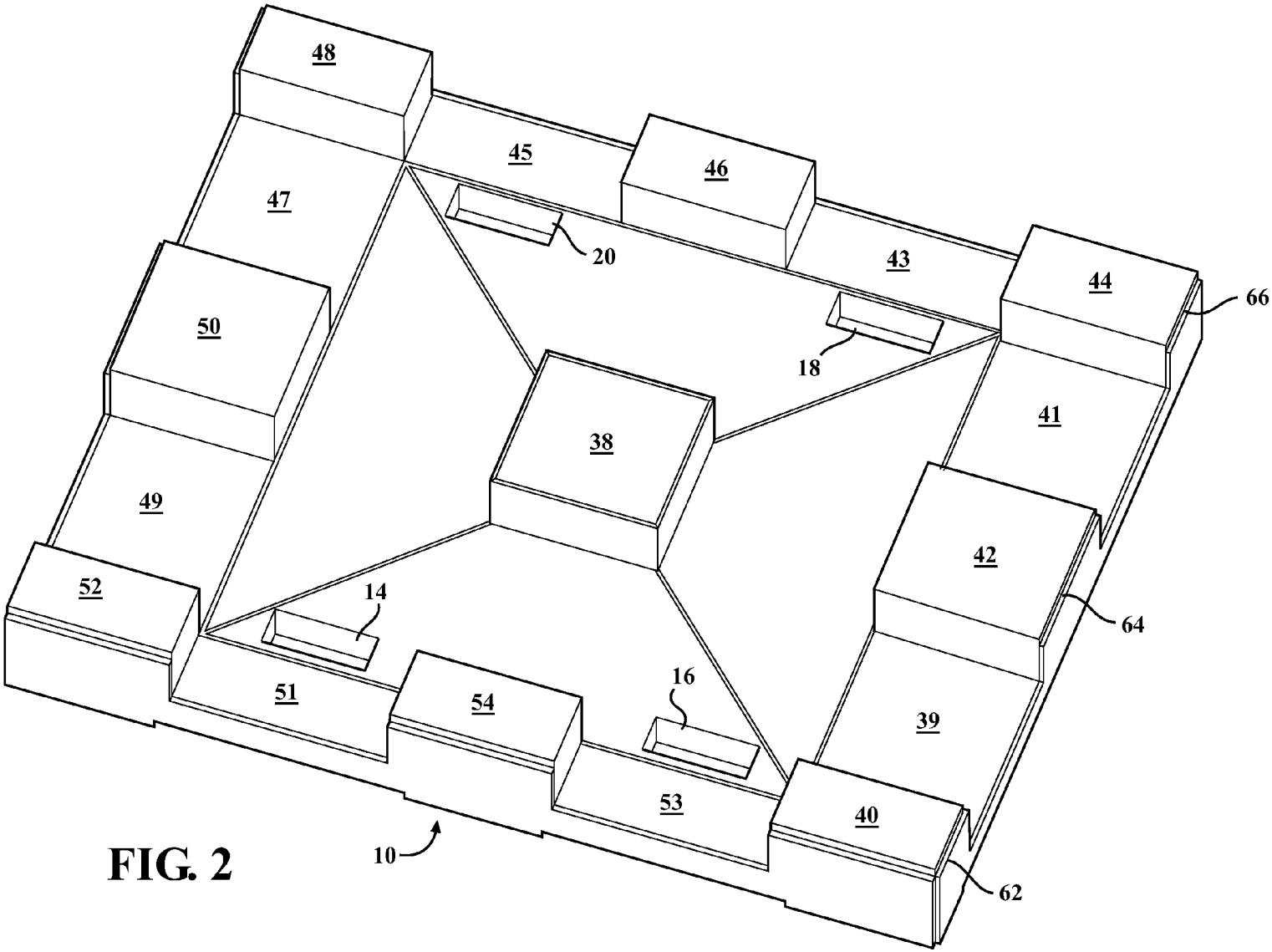
FIG. 2 is a rotated underside view of the pallet design of FIG. 1 and further depicting such features as seating edge profiles established between upper and lower perimeter edges of each pallet for facilitating multiple stack-ability combined with forklift receiving gaps and interior hand hold apertures for permitting individual manipulation.

With reference to FIG. 2, the structural defining body 10 includes both side edge extending and central interior deepened sections (see deepened interior section 38 combined with spaced and perimeter side extending deepened sections 40, 42, 44, 46, 48, 50, 42 and 54). The deepened sections, when combined with the shallower partition sections which collectively define the surface area of the pallet body (this matching the surface board material 12), establish the underside accessible configuration of the pallet body 10. The gaps established between the deepened sections 38, 40, 42, 44, 46, 48, 50, 52 and 54 define forklift receiving gaps (see inverted underside locations depicted in pairs 39 & 41, 43 & 45, 47 & 49, and 51 & 53 in FIG. 2).

Viewing FIG. 1 in combination with FIG. 2, selected individual pluralities of seating edge profiles are established between upper (see in FIG. 1 at 56, 58, 60 et seq.) and lower (in FIG. 2 at 62, 64, 66, et seq.) perimeter edges of each pallet and, upon configuring such opposing seating profiles around entire upper and lower perimeters of each body as shown, facilitating multiple stack-ability of the bodies (e.g. pallets) when either being stored or transported. The perimeter spaced and locating profiles are configured such that top surface projecting edge portions (again at 56, 58, 60 et seq.) shoulder around and upon inwardly stepped or recessed edge portions (again underside surface location 62, 64, 66, et seq.) corresponding to an underside of an upper stacked pallet body. In this fashion, the stacked plurality of bodies are prevented from toppling and/or laterally displacing relative to one another.

As again representatively shown in such as FIG. 4, additional diagonal supporting partitions are provided, such as associated with the edge defining deepened sections (these representatively depicted by pairs of diagonal overlapping reinforcing partitions 68 (corresponding to deepened section 50 in FIG. 2), partitions 70 (deepened section 46) and partitions 72 (deepened section 42). In this fashion, and when combining the strength achieved by the construction and arrangement of the partition sections with the installed skeletal rods, the pallet exhibits the combined properties of lightweight and enhanced strength. Also, shown in FIG. 4 are additional diagonal offset extending reinforcing support locations, representative portions of which are shown at 65, 67, 69 and 71 in double walled configuration (with contiguous single wall constructions also being shown which extend to the outermost perimeter and corner proximate locations of the pallet body), and which combine with the inserted and crosswise overlapping bamboo or like sections 32 and 36 in order to provide additional internal structural rigidity to the assembly.

Figure 5:
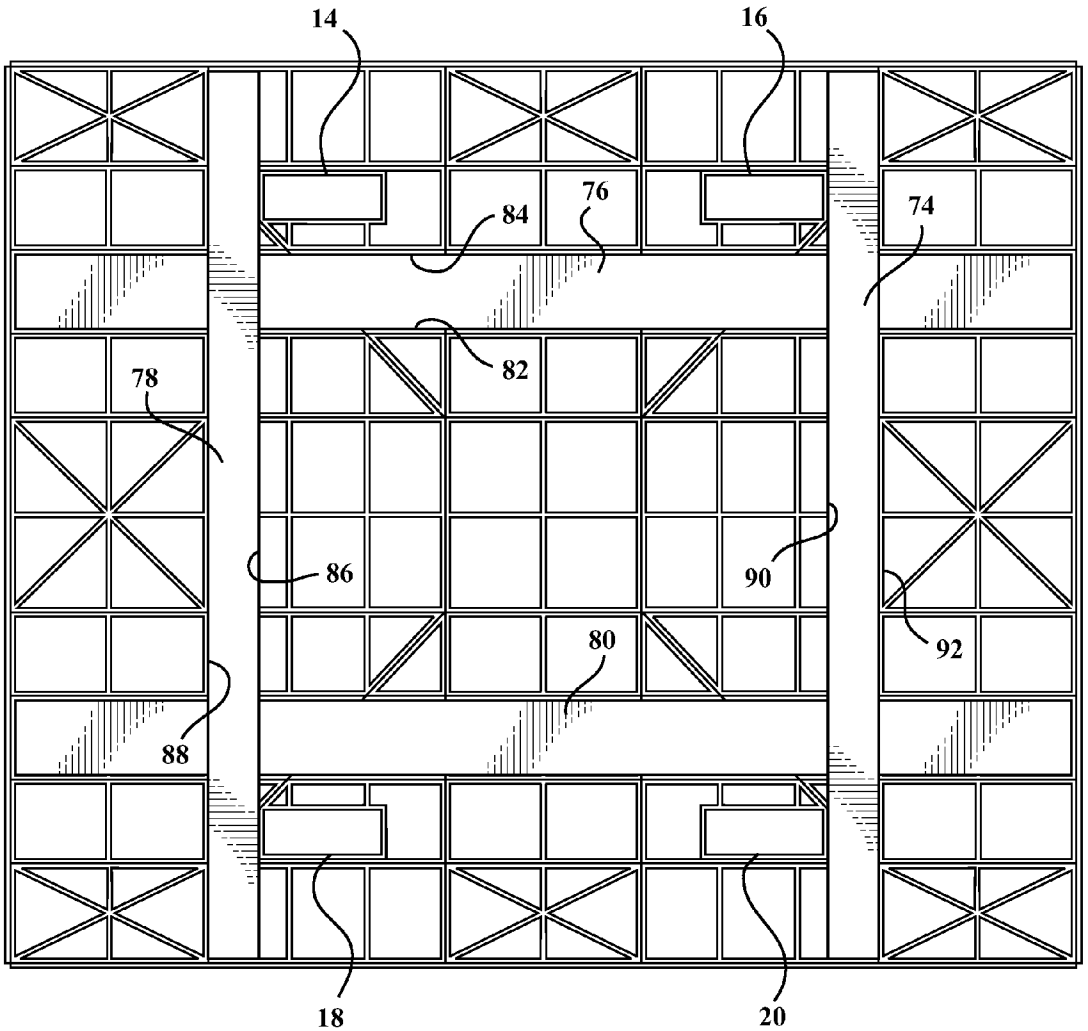
FIG. 5 is an illustration similar to FIG. 4 and illustrating a modified structural defining pallet which seats a plurality of grid defining 2×4 members.

Referring now to FIG. 5, an illustration similar to FIG. 4 is shown and depicts a modified structural defining pallet which is configured for seating a plurality of grid defining 2×4 members or sections 74, 76, 78 and 80. Without elaboration, the inner recessed configurations associated with the bamboo variant of FIG. 1 are revised, such as depicted at representative locations by spaced apart inner opposing surfaces 82 & 84 (associated with elongated member 76), 86 & 88 (associated with elongated member 78), and 90 & 92 (associated with elongated member 74).

In construction, the interior configuration of the body is such that it is capable of seating in inner elongate extending fashion such elongated members not necessarily limited to the 2×4 sections shown, and in any type of overlapping or keyed/notched seating fashion (such as including those previously described) and further so as to define an enhanced structurally supporting article exhibiting a desired set of weight and performance characteristics. Otherwise, the remaining features of the pallet construction remain as previously described such that a duplicate description for each of the remaining figures is unnecessary.

Figure 6:
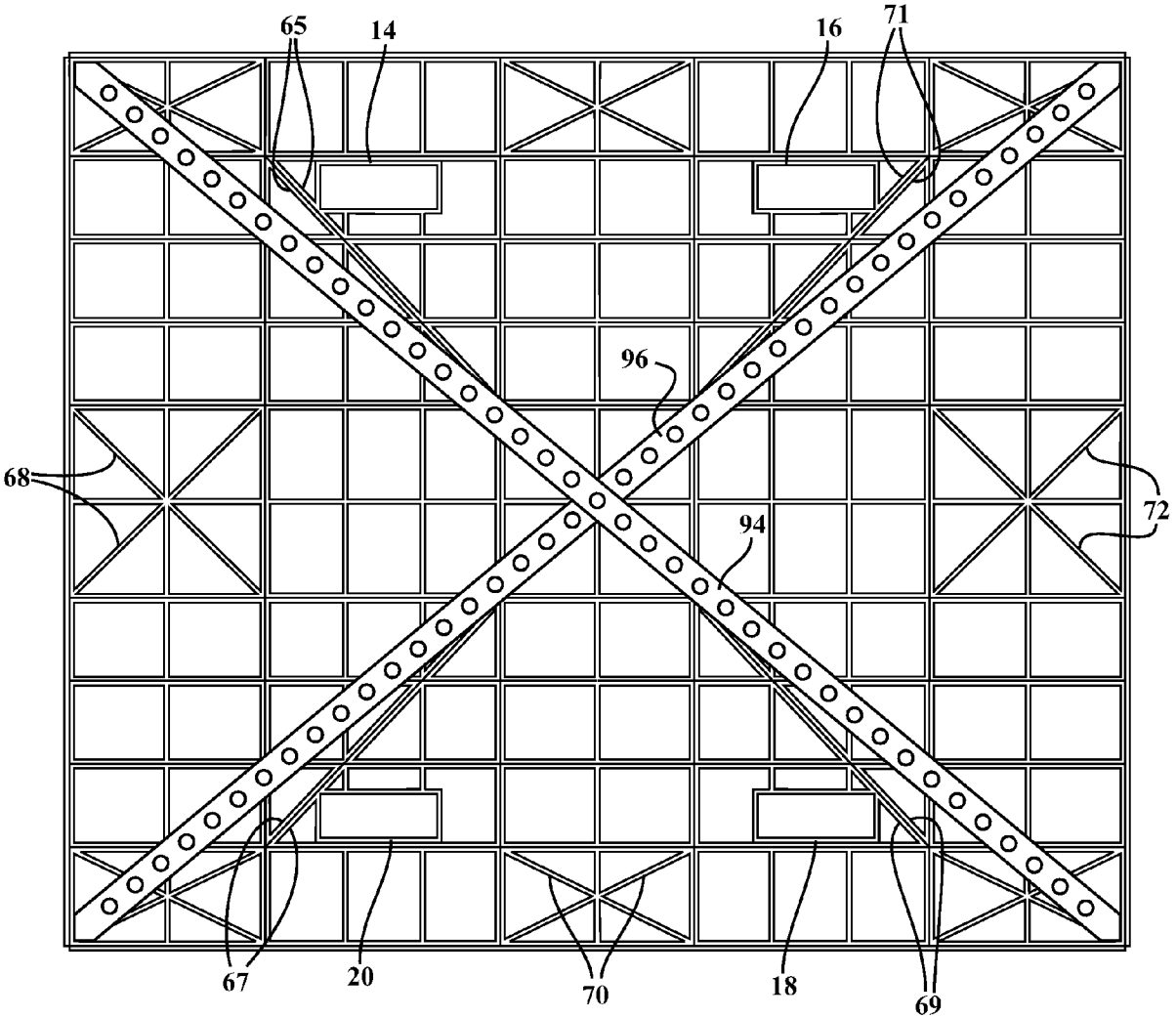
FIG. 6 is another alternate configuration similar to FIG. 4 in which a pair of aluminum or steel bars substitute for the bamboo sections.
Figure 7:
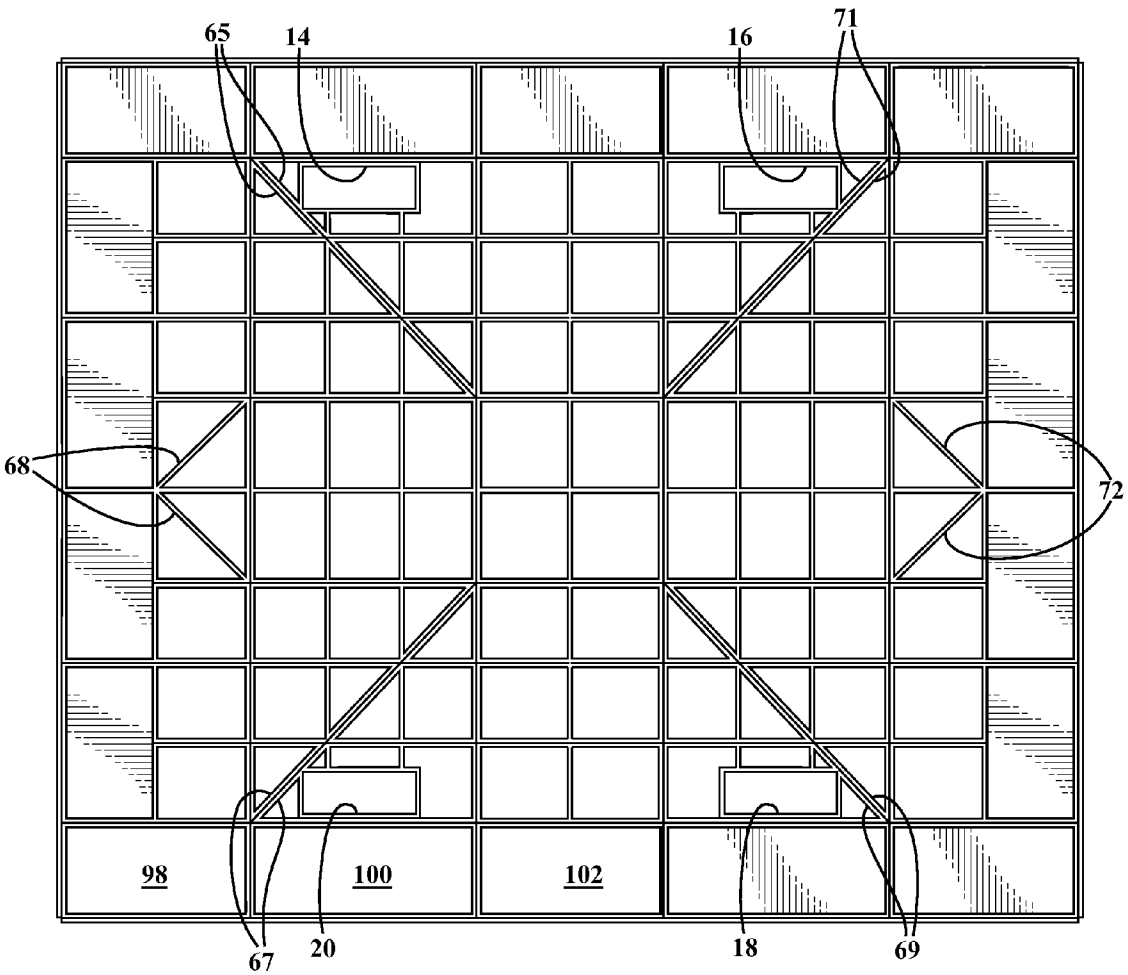
FIG. 7 is a further variant of an underside plan view of pallet design similar to FIG. 4 and in which a plurality of perimeter edge located foam sections are incorporated into the pallet body construction in order to provide impact absorbance and resistance to such as impinging lift forks which are not properly aligned with the dimensioned forklift receiving apertures.

FIG. 6 is another alternate configuration similar to FIG. 4 in which a pair of aluminum or steel bars, at 94 and 96, substitute for the bamboo sections such as depicted at 32 and 36 in FIG. 4. FIG. 7 is a further variant of an underside plan view of pallet design similar to FIG. 4 and in which a plurality of perimeter edge located foam sections 98, 100, 102, et sq., are incorporated into a reconfigured pallet body construction in order to provide impact absorbance and resistant, such as in response to external objects (including the front inserting surfaces of lift forks). Comparing to FIG. 4, the configuration of FIG. 7 repeats many of the inner and reinforcing grid defining features previously described, with the exception that the outer perimeter sections are replaced partially or entirely with the block like foam sections 98, 100, 102 et seq.

Figure 8:
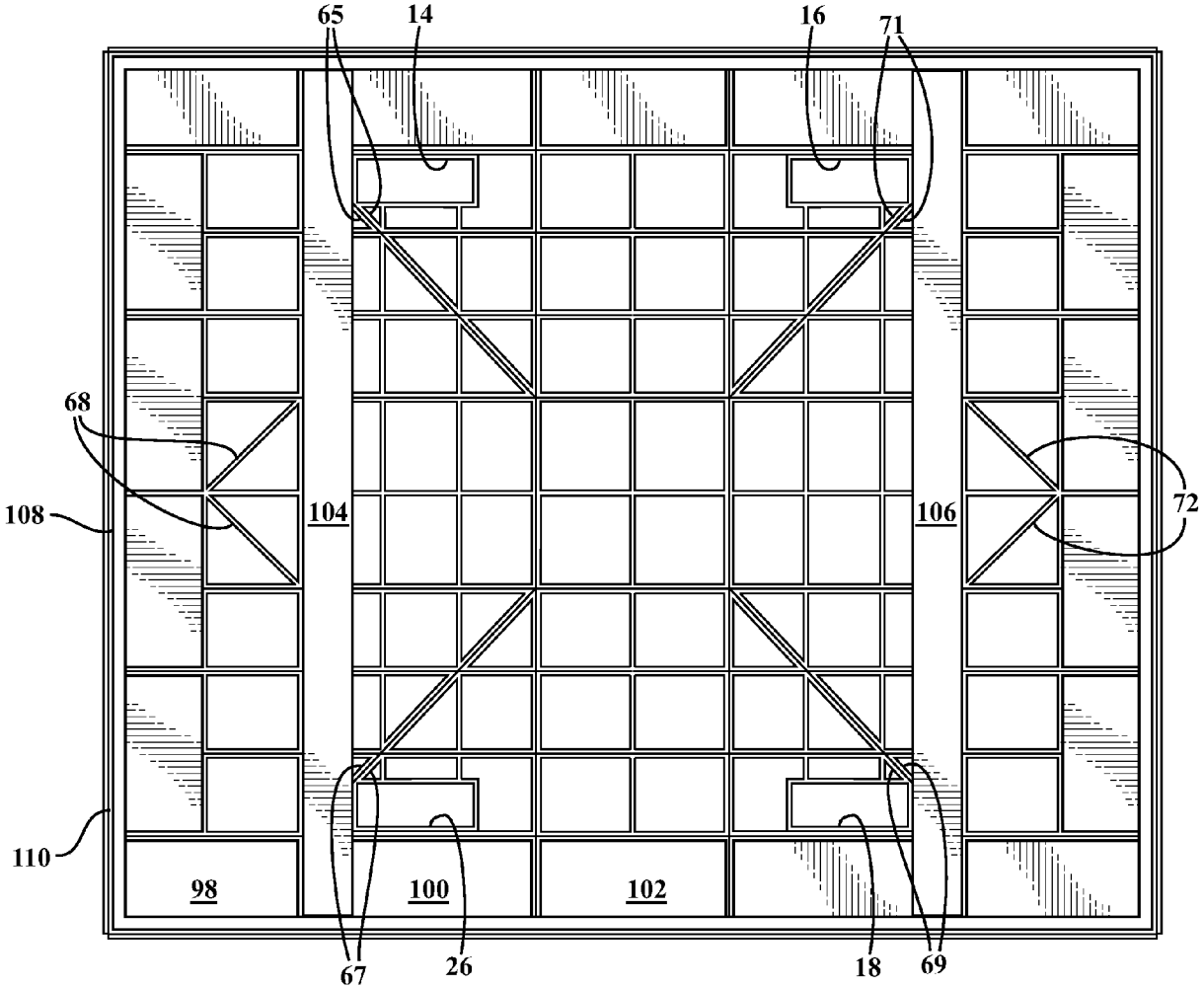
FIG. 8 is a further sub-variant of pallet design which combines the perimeter located foam sections in combination with inner structural enhancing 2×4 sections.

FIG. 8 is a further sub-variant of pallet design, such as similar in many respects to that shown in FIG. 7, and which combines the perimeter located foam sections, again 98, 100, 102, et seq., with inner structural enhancing 2×4 sections 104 and 106. The perimeter edge of the pallet further exhibits an intermediate wood strip 108 (itself applied over the foam blocks) and in turn over which is covered a corrugated edge strip 110 or the like and such that these features, in combination with the foam or other energy absorbent and perimeter spaced blocks 98, 100, 102 et seq., provide enhanced energy absorption characteristics in addition to exception load bearing support along with relatively light weight.

Figure 9:
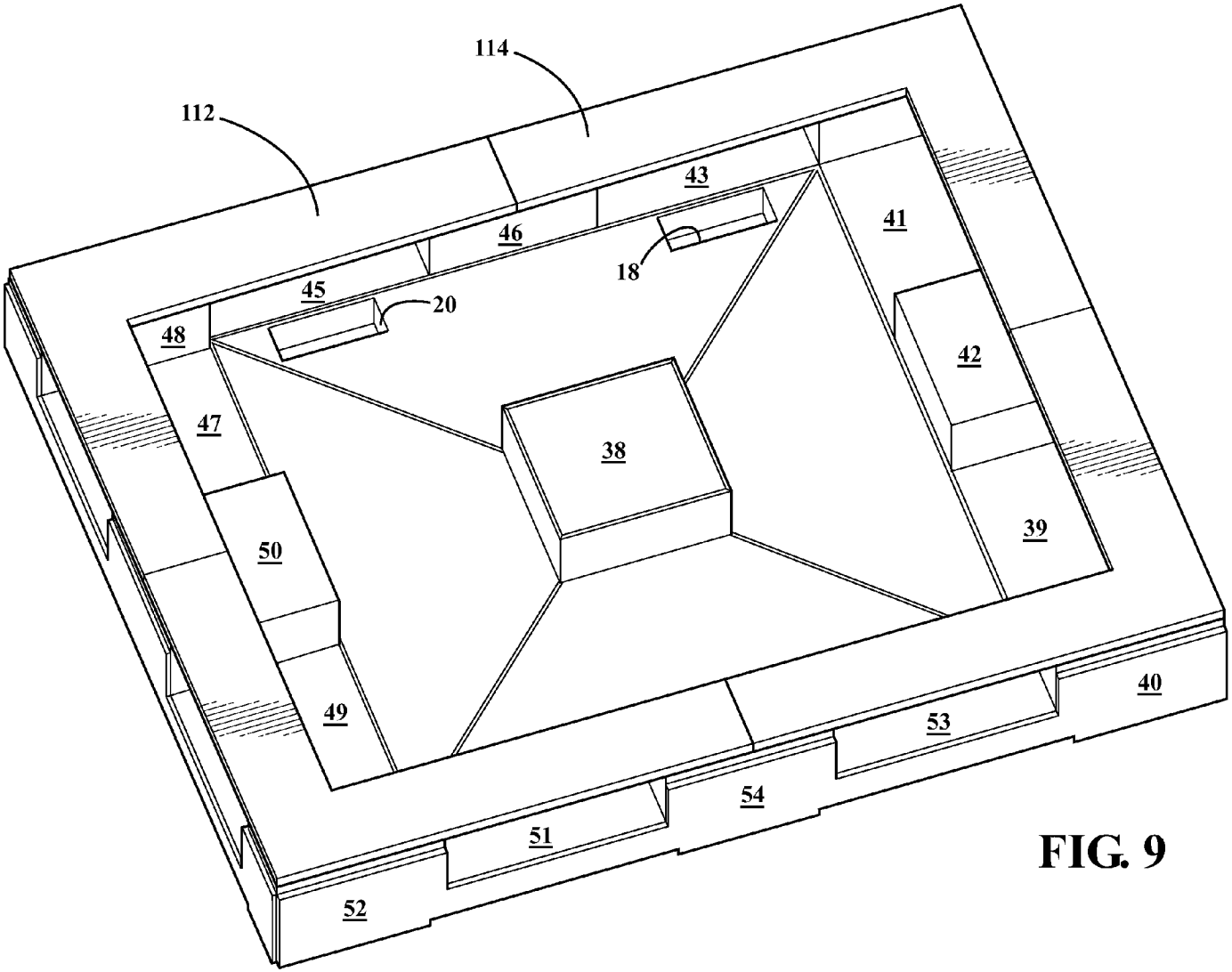
FIG. 9 is an underside perspective similar to FIG. 2 and in which a frame portion is secured upon the perimeter extending underside of the pallet body such as for use upon open loop or other types of automated conveyors.

Finally, FIG. 9 is an underside perspective similar to FIG. 2 and in which a frame portion (see "U" shaped subsections 112 and 114) are secured upon the perimeter extending underside of the pallet body. Although not shown, the underside secured frame portion was provided for use upon open loop or other types of automated conveyors and for which the forklift gaps in the underside might otherwise cause problems in stability or location.

Having described my invention, other and additional preferred embodiments will become apparent to those skilled in the art to which it pertains and without deviating from the scope of the appended claims.

I claim:

1. A reinforced pallet comprising:

a three dimensional body exhibiting a planar top, interconnecting sides and a bottom, an interior of said body being constructed of a plurality of intersecting and partition defining members extending between said top and bottom and in each of crosswise and diagonal fashion within and throughout said interior, a sub-plurality of said partition defining members further defining notched locations for seating a plurality of extending inner skeletal members in either or both of diagonal or crosswise extending fashion, said notched locations further defining a continuous passageway extending between said sides and opposite corners of said body for receiving said inner skeletal members;

a corrugated surface board material applied over said top and sides as well as an adjoining underside of said body; and inner perimeter defined handholds defined at spaced apart locations of said body and extending through said surface board and inner partition defining locations.

2. The pallet as described in claim 1, the corrugated material further comprising a paperboard or plastic.

3. The pallet as described in claim 1, said skeletal members further comprising any of a bamboo, steel or aluminum rod, wooden 2×4 or other elongated and structurally defining members.

4. The pallet as described in claim 1, A further comprising inner perimeter defined handholds defined through said surface board and body.

5. The pallet as described in claim 1, further comprising a plurality of foam defining sections arranged around a perimeter of said body.

6. The pallet as described in claim 1, further comprising a frame portion secured upon a perimeter extending underside of the pallet body.

7. The pallet as described in claim 1, A said body further comprising a shallower partition defining body combined with interspersed and deepened partition defining sections along both perimeter and interior locations and which collectively define underside receiving forklift apertures.

8. The pallet as described in claim 1, further comprising top and bottom pluralities of spaced apart and edge extending profiles projecting from said interconnecting sides of each of a plurality of said bodies for facilitating multiple stackability.

* * * * *